US007901560B2

(12) United States Patent
Storesund

(10) Patent No.: US 7,901,560 B2
(45) Date of Patent: Mar. 8, 2011

(54) METHOD AND A PREBAKED ANODE FOR ALUMINIUM PRODUCTION

(75) Inventor: Arild Storesund, Kopervik (NO)

(73) Assignee: Norsk Hydro ASA, Oslo (NO)

( * ) Notice: Subject to any disclaimer, the term of this patent is extended or adjusted under 35 U.S.C. 154(b) by 550 days.

(21) Appl. No.: 11/922,234

(22) PCT Filed: Jun. 9, 2006

(86) PCT No.: PCT/NO2006/000221

§ 371 (c)(1),
(2), (4) Date: Mar. 4, 2008

(87) PCT Pub. No.: WO2006/137739

PCT Pub. Date: Dec. 28, 2006

(65) Prior Publication Data

US 2009/0114548 A1 May 7, 2009

(30) Foreign Application Priority Data

Jun. 22, 2005 (NO) ..... 20053072

(51) Int. Cl.
*C25C 3/12* (2006.01)
*C25B 11/12* (2006.01)
*C25B 11/02* (2006.01)

(52) U.S. Cl. ..... 205/380; 205/381; 205/387; 204/294; 204/246; 204/247

(58) Field of Classification Search ..... 204/246, 204/247, 294; 205/380, 381, 387
See application file for complete search history.

(56) References Cited

U.S. PATENT DOCUMENTS

| | | | | |
|---|---|---|---|---|
| 2,958,641 | A | 11/1960 | Reynolds | |
| 3,438,876 | A | 4/1969 | Marshall, Jr. | |
| 4,602,990 | A * | 7/1986 | Boxall et al. | 204/247.3 |
| 4,605,481 | A | 8/1986 | Langon | |
| 7,179,353 | B2 * | 2/2007 | Barclay et al. | 204/246 |
| 7,384,521 | B2 * | 6/2008 | Wang et al. | 204/294 |
| 7,470,354 | B2 * | 12/2008 | Lorentsen et al. | 205/381 |
| 2007/0045104 | A1 * | 3/2007 | Wang et al. | 204/206 |
| 2007/0125643 | A1 * | 6/2007 | Barclay et al. | 204/284 |
| 2007/0125660 | A1 * | 6/2007 | Barclay et al. | 205/376 |

FOREIGN PATENT DOCUMENTS

EP 0 264 263 4/1988

OTHER PUBLICATIONS

International Search Report issued Sep. 27, 2006 in the International (PCT) Application of which the present application is the U.S. National Stage.
Patent Cooperation Treaty (PCT) International Preliminary Report on Patentability, issued Sep. 28, 2007.

* cited by examiner

*Primary Examiner* — Bruce F Bell
(74) *Attorney, Agent, or Firm* — Wenderoth, Lind & Ponack, L.L.P.

(57) ABSTRACT

A method of producing aluminium in a Hall-Héroult cell with prebaked anodes, as well as anodes for the same. The anodes are provided with slots in a wear (bottom) surface thereof for gas drainage. The slots are 2-8 millimeters wide, and preferably 3 millimeters.

8 Claims, 3 Drawing Sheets h1 = 350 mm
h2 = 320 mm
slot width = 3 - 8 mm
l = 1510 mm
h3 = 600 mm
b = 700 mm

METHOD AND A PREBAKED ANODE FOR ALUMINIUM PRODUCTION

BACKGROUND OF THE INVENTION

1. Technical Field

The present invention relates to an optimized method for performing an electrolysis process for producing aluminium in accordance with the Hall-Héroult process with prebaked anodes, and anodes therefore.

2. Description of the Related Art

In a process as described above, there will be evolved gas at the wear-surface (primary the underside or bottom side) of anodes due to the reduction of alumina. In particular carbon dioxide gas will accumulate at this surface, causing variations and instabilities in the electrical contact from the anode to the electrolyte. This physical phenomena have several drawbacks, such as:

- Increased back reaction and loss of current efficiency due to close contact between the produced aluminium layer and $CO_2$ gas bubbles.
- Increased possibility and duration of anode effects
- Heat production in the gas layer results in a reduced interpolar distance and reduced current density on the cell. An increase in current density will increase the production on the cells.

The extra IR-drop (Interpolar Resistance drop) because of the gas bubbles in the electrolyte has been measured to be 0.15-0.35 volt in alumina reduction cells (1992, The $11^{th}$ International Course on Process Metallurgy of Aluminium page 6-11).

There have been several proposals for minimizing the above mentioned problem, such as introducing anodes with a sloped or tilted bottom, forming slots or tracks in the wear surface of the anodes to drain the gas away from this area.

Slots in prebaked anodes are normally produced in a vibrator compactor when the anode mass is in a green state, or in a dry milling process that is performed on the calcinated anodes. The dry milling process is normally performed by the use of a circular saw. In accordance with commonly available production methods of today, slots can be produced with a width that is approximately 13-15 mm.

There are some minuses by having slots in the anode surface, and it will be mentioned here:

- Reduced anode life time in the cell because anode mass is removed
- Reduced anode working surface area
- Extra carbon material have to be transported back to the carbon mass factory (dry milling)
- Extra energy In the milling operation (dry milling)

All these drawbacks can be reduced by making the slots more narrow. Thus, the slots should not be wider than necessary to effectively drain the anode gases from the working surface A study carried out and reported in "R. Shekar, J. W. Evans. Physical modelling studies of electrolyte flow due to gas evolution and some aspects of bubble behaviour in advanced Hall cells, Part III. Predicting the performance of advanced Hall cells, Met. and Mat. Trans.,Vol. 27 B. February 1996, pp. 19-27", indicates that tracks with a width less than 1 cm did not drain the gas properly.

SUMMARY OF THE INVErfTIQN

Despite the teaching above, the applicant now has performed initial studies in an electrolysis cell applying anodes with very thin slots, which has proven to give sufficient gas drainage.

The anodes involved in the studies were calcinated and processed by implementing a processing technique known from processing/cutting other types of materials.

By making the slots in the calcinated anode thinner than that of the prior art, the above mentioned disadvantages will be less.

Since the thin slots take away only a small fraction of the anode mass, potentially a high number of slots can be used.

The drop in bath voltage when using slots allows amperage increase in the alumina reduction cell, increasing the production of aluminium and decreasing the specific energy consumption. This advantage is improved when using narrow slots, because of the earlier mentioned fact that only a small fraction of the anode mass is removed even when using several narrow slots.

These and further advantages can be achieved with the invention as defined in the accompanying set of claims.

BRIEF DESCRIPTION OF THE DRAWINGS

In the following, the invention shall be described further with reference to examples and figures where.

DETAILED DESCRIPTION OF THE INVENTION

Figure 1:
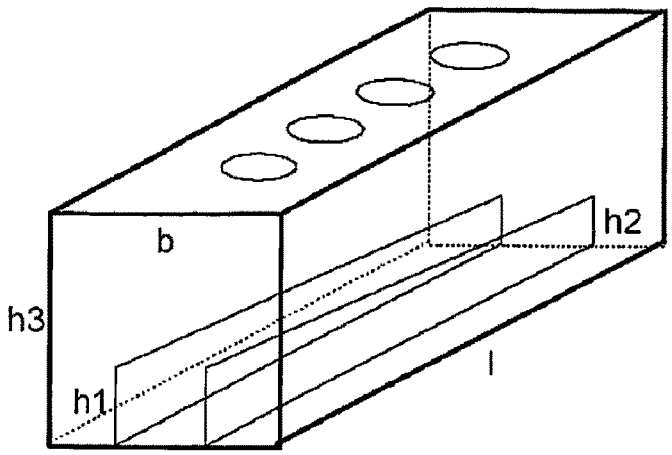
FIG. 1 is a perspective view of one anode in accordance with the present invention.

As disclosed in FIG. 1, there is shown an anode having slots processed into it and where the width of the slots are between 3-8 millimeters. Further, there are indicated two slots having a cantilevered bottom, where its depth at one end of the anode h2 is 320 millimeters and the depth at the other end h1 is 350 millimeters. The overall dimensions of the anode in this example is length, l=1510 millimeters, height h3=600 millimeters and width b=700 millimeters. Thus, the slots in this embodiment extend through more than 50% of the height of the anode. The cantilevered bottom can be sloped corresponding to >0° and <10°.

Figure 2:
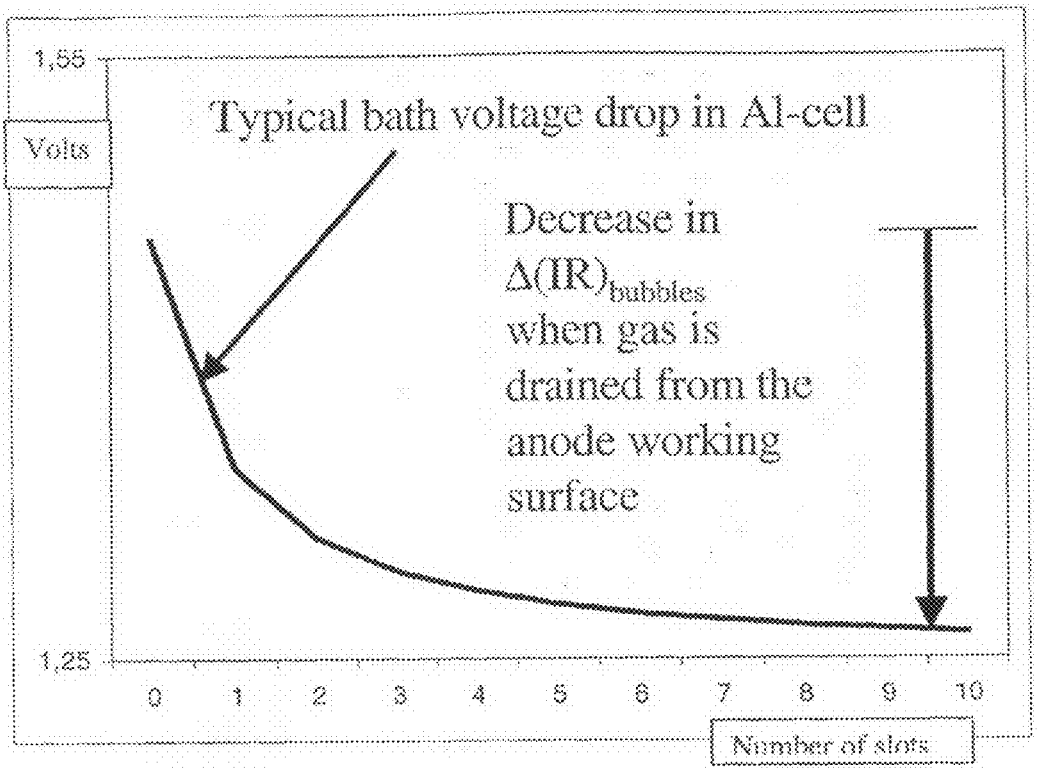
FIG. 2 is a graph showing bath voltage drop in alumina reduction cell versus number of slots.

In FIG. 2 is indicated how the bath voltage might decrease when an increasing number of slots is introduced in the anode. Actual numbers would vary with the anode width and length, the current density, and slot design. Voltage is indicated at the vertical axis, number of slots at the horizontal axis.

In the full-scale studies carried out, it has been observed that the depth of the slots will increase slightly due to the erosion in the electrolysis process. This effect is caused by the fact that the gas drained into the slots from the bottom of the anode will consume carbon material in the bottom of the slot due to the Boudoard reaction (CO2+C=2CO). A consumption of 2-3 centimeters of carbon material in the bottom of the slots has been observed in an anode that had been utilized in the cell for 17 days, i.e. 60% worn anode.

This self-propelled slot extending effect must be taken into account when determining the processing depth of the slots.

By the new method of processing the slots, there will be produced fine-grained dust that can easily be returned back to the mass factory. In fact, the dust produced will replace a certain type of dry dust that is needed in the mass factory anyway. Thus, instead of having a problem with excessive material to be recycled, the new processing method produces a useful material as a byproduct of the method.

Figure 3:
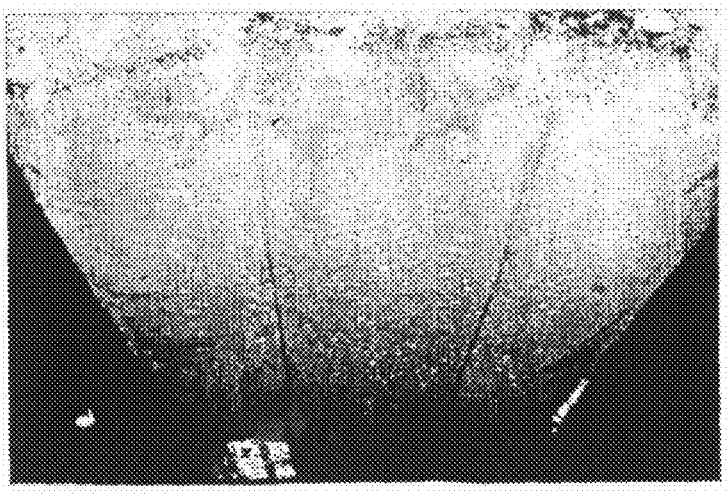
FIG. 3 is a photo of one anode in accordance with the invention.

FIG. 3 discloses a photo of one anode in accordance with the present invention, showing the wear surface (the bottom side) of the anode. The anode has been removed from the cell after a period of production. The two longitudinal lines disclosed in the photo are the slots.

Figure 4:
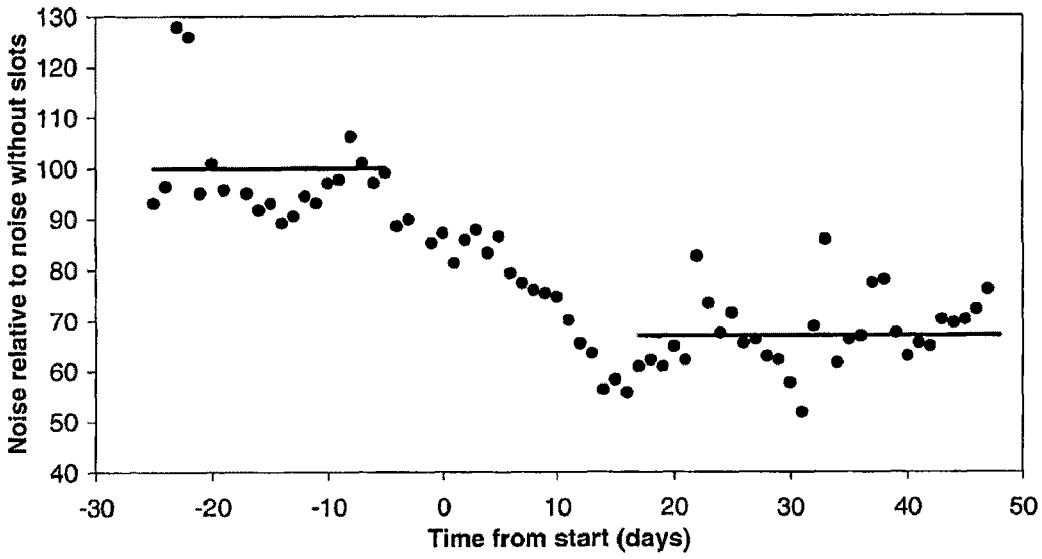
FIG. 4 is a graph showing process data extracted from one full-scale study, applying anodes in accordance with the present invention

FIG. 4 discloses cell noise data, extracted from one full-scale study, applying anodes in accordance with the present invention. As shown in the figure, it is possible to run the electrolysis process in a more stable manner than that of non-processed anodes.

The drop in voltage noise in the cell is at least the same as obtained earlier in cells having traditional slots of width of 12-15 millimeters, indicating that the 3 mm slot width is sufficient to remove the carbon dioxide gas from the working surface of the anode.

A further comparison between anodes with 3 millimeters wide slots and anodes with 15 millimeters wide slots shows that even with the same number of slots the advantage is considerable: For an anode of 100 cm width and provided with two 15 millimeters wide slots, the anode working surface was reduced by 3%. In an anode constructed in accordance with the present invention, two slots of 3 millimeters width reduce the working surface by only 0.6%.

It is assumed that the invention will work with even more narrow slots, for instance 2 millimeters, but it has not been practically possible to verify that as of yet.

The invention claimed is:

1. A method of producing aluminium in a Hall-Héroult cell with pre-baked carbon anodes, each of the anodes having a wear surface, the method comprising draining gas away from the wear surfaces by forming one or more continuous slots in the wear surfaces of the anodes, the gas drainage being performed by the slots having a width of 2-8 millimeters.

2. The method in accordance with claim 1, wherein the gas drainage is performed by providing two or more slots in the wear surface of each anode.

3. The method in accordance with claim 1, wherein each of the slots has a bottom that is sloped at an angle that is greater than 0° and less than 10°.

4. A prebaked anode for a Hall-Héroult cell for production of aluminium, the anode having one or more open-ended slots arranged in a bottom surface of the anode for gas drainage, wherein:

each slot formed in the bottom surface is continuous such that the slot passes through one side of the anode and through an opposite side of the anode;

each slot formed in the bottom surface has a width of 2-8 millimeters; and each slot formed in the bottom surface is sloped at an angle.

5. A prebaked anode in accordance with claim 4, wherein each slot formed in the bottom surface has a width of 3 millimeters.

6. A prebaked anode in accordance with claim 4, wherein the bottom surface of the anode has two or more slots.

7. A prebaked anode in accordance with claim 4, wherein the one or more slots penetrate the bottom surface of the anode to an extent that represents more than 50% of the anode height.

8. A prebaked anode in accordance with claim 4, wherein the bottom of each slot is sloped at an angle between 0° and 10°.

* * * * *